US011280535B2

(12) United States Patent
Zvida

(10) Patent No.: US 11,280,535 B2
(45) Date of Patent: Mar. 22, 2022

(54) PICNIC COOLER WITH OFF/ON SPIGOT AND TWO SEALING RINGS WITH APERTURES

(71) Applicant: Itamar Josh Zvida, Karmiel (IL)

(72) Inventor: Itamar Josh Zvida, Karmiel (IL)

( * ) Notice: Subject to any disclaimer, the term of this patent is extended or adjusted under 35 U.S.C. 154(b) by 20 days.

(21) Appl. No.: 17/089,206

(22) Filed: Nov. 4, 2020

(65) Prior Publication Data

US 2021/0048236 A1 Feb. 18, 2021

Related U.S. Application Data

(63) Continuation-in-part of application No. 16/383,610, filed on Apr. 14, 2019, now abandoned, which is a continuation-in-part of application No. 16/232,092, filed on Dec. 26, 2018, now abandoned, which is a continuation-in-part of application No. 15/525,068, filed as application No. PCT/IL2015/051082 on Nov. 10, 2015, now abandoned.

(30) Foreign Application Priority Data

Nov. 12, 2014 (IL) ..... 235670

(51) Int. Cl.
*F25D 3/00* (2006.01)
*F25D 29/00* (2006.01)
*F25D 17/00* (2006.01)

(52) U.S. Cl.
CPC ..... *F25D 3/00* (2013.01); *F25D 17/00* (2013.01); *F25D 29/003* (2013.01); *F25D 2700/12* (2013.01)

(58) Field of Classification Search
CPC . F25D 3/107; F25D 3/00; F25D 17/00; F25D 29/003; F25D 2201/12; F25D 2303/0831; F25D 2303/085; F25B 19/005; F25B 2341/062; F25B 41/37; B65D 81/382
See application file for complete search history.

(56) References Cited

U.S. PATENT DOCUMENTS 3,385,073 A * 5/1968 Snelling ..... F25D 3/105 62/52.1
3,633,381 A * 1/1972 Haaf ..... F25D 3/107 62/222
5,325,678 A * 7/1994 Borah ..... F25D 29/001 236/46 F
2010/0100243 A1* 4/2010 Lee ..... F25D 29/00 700/275
2016/0102898 A1* 4/2016 Junge ..... F25B 41/37 62/528

* cited by examiner

*Primary Examiner* — Elizabeth J Martin

(57) ABSTRACT

A picnic cooler that includes a food compartment, a gas tank compartment, an off/on electric spigot, a first sealing rings with a first apertures a second sealing ring with a second aperture, and two cooling apparatuses. The cooling apparatus includes a twisting piping system and an upper metallic plate that serves as the bottom of the food compartment. The ratio between the diameter of the second aperture and the diameter of the first aperture is between 1.8 to 2.2 and the ratio between the inner surface area of the food compartment and the outer surface area of the first and second piping systems is between 9 to 17.

1 Claim, 3 Drawing Sheets

PICNIC COOLER WITH OFF/ON SPIGOT AND TWO SEALING RINGS WITH APERTURES

RELATED APPLICATIONS

This application is a continuation in part of U.S. patent application Ser. No. 16/383,610 filed on Apr. 14, 2019 which is a continuation in part of U.S. patent application Ser. No. 16/232,092 filed on Dec. 26, 2018, which is a continuation in part of U.S. patent application Ser. No. 15/525,068 filed on May 7, 2017, which is a National Phase of PCT Patent Application No. PCT/IL2015/051082 having International filing date of 10 Nov. 2015, which claims the benefit of priority of IL Patent Application No. 235670 filed on 12 Nov. 2014. The contents of the above applications are all incorporated by reference as if fully set forth herein in their entirety.

TECHNICAL FIELD

The present invention refers to a picnic cooler with a cooling mechanism that is based on the introduction of carbon dioxide (CO2) into two cooling apparatuses through fixed size apertures in two sealing ring.

BACKGROUND ART

The use of picnic coolers is very prevalent. It is common practice to place ice packs (plastic containers containing a frozen substance) inside coolers so as cool the interior of the cooler as well as the food that is stored in it. The problem is that ice packs only stay frozen for a limited amount of time only, and when the cooler is used outdoors, the user often wishes to keep the cooler contents chilled for longer periods of time and additional ice packs are often unavailable. The present invention offers an effective and good solution to this problem.

Publication U.S. Pat. No. 6,205,794 (Hereinafter "US794") discloses a cryogenic storage tank device for biological specimens that is surrounded in part by a reservoir that is designed to receive liquid nitrogen and by that to chill the tank. The device of US794 has a different structure than the picnic cooler subject matter of the present invention, for example said device does not have an off/on electric spigot, a first sealing ring with a narrow aperture, a first cooling apparatus, a second sealing ring with a narrow aperture and a second cooling apparatus, which are important components of the picnic cooler (100).

Publication U.S. Pat. No. 3,410,109 (Hereinafter "US109") discloses a freezer having a storage compartment refrigerated by vaporization of liquid nitrogen discharged under pressure into the compartment form refillable tanks housed within a separated chamber. The freezer of US109 has a different structure than the picnic cooler subject matter of the present invention, for example said freezer does not have an off/on electric spigot, a first sealing ring with a narrow aperture, a first cooling apparatus, a second sealing ring with a narrow aperture and a second cooling apparatus, which are important components of the picnic cooler (100).

Publication US2013008182 (Hereinafter "US182") mentions by the way an apparatus for storing perishable food with an independent cooling mechanism based on liquid nitrogen that comprises a dedicated compartment for a nitrogen tank. However, the apparatus of US182 does not have an off/on electric spigot in the meaning as explained in this application, does not have two sealing ring with a narrow apertures and does not have a first and second cooling apparatuses as the picnic cooler of the present invention has.

Publication US2006053828 (Hereinafter "US828") discloses a cooler using dry ice as a cooling agent. The cooler of US828 has a different structure than the picnic cooler subject matter of the present invention, for example said cooler does not have an off/on electric spigot, a first sealing ring with a narrow aperture, a first cooling apparatus, a second sealing ring with a narrow aperture and a second cooling apparatus, which are important components of the picnic cooler (100).

DESCRIPTION OF THE DRAWINGS

The intention of the drawing attached to the application is not to limit the scope of the invention and its application. The drawing is intended only to illustrate the invention and it constitutes only one of its many possible implementations.

THE INVENTION

Figure 1:
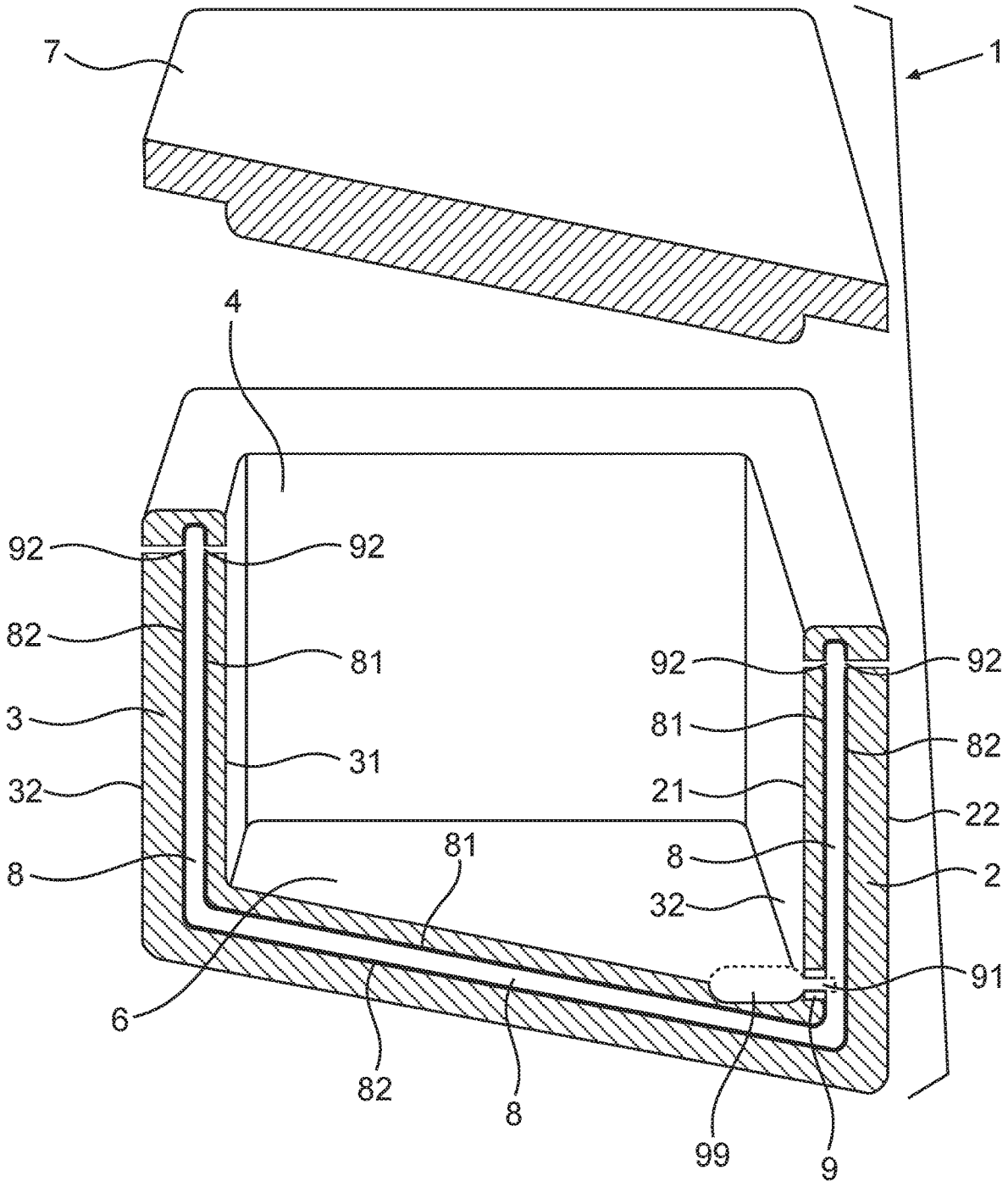
FIG. 1 depicts a cross section of the cooling apparatus (1) that includes the internal compartment (8), an adapter (9), passage (91) and a ventilation opening (92).

The main objective of the present invention is to provide a picnic cooler with an independent cooling mechanism that is based on the use of compressed carbon dioxide at a very low temperature. The four sides and bottom of the cooler each include an internal compartment made of a metallic material, preferably stainless steel.

Each such internal compartment has two, or more, apertures: one aperture leads from the compartment to the interior of the cooler and/or to the exterior of the cooler, and the second aperture connects to an adapter that is designed to connect to a carbon dioxide canister, which introduces into the compartment carbon dioxide at a very low temperature. The encounter between the carbon dioxide and the oxygen in the air within the internal compartment and with the sides of the compartment causes rapid cooling of the compartment, to a very low temperature, and as a result to the cooling of the inner sides of the picnic cooler, the interior of the cooler, and its contents. Using carbon dioxide for said purpose is very effective; it may be stored at a relatively low pressure, and it is neither flammable, toxic, nor explosive.

In principle, the connector, which is designed to enable the introduction of carbon dioxide from a separate canister into the internal compartment, may be positioned in the external side of the picnic cooler or within the cooler itself, as depicted for instance in the attached drawings. Internal compartments may be located within one, two, three, or all four sides of the cooler and also in the bottom of the cooler. The figures attached to the application depict a picnic cooler with internal compartments in all four sides as well as in the bottom of the cooler. In these drawings, the connector designed to connect to the carbon dioxide canister is located within the cooler.

The picnic cooler (1), subject of the present invention, is shaped externally like any other standard picnic cooler, and has four sides: right side (2), left side (3), back side (4) and front side, not shown in the figures, a bottom (6), and a cover (7). The cooler (1) and its standard components may be made of materials customarily used to manufacture coolers. For instance, the inner and outer sides may be made of rigid plastic with an insulating material in between, such as foam rubber and so.

The internal compartments (8), located within the walls of the cooler (1), are made of a metallic material such as stainless steel, or any other known material that cools efficiently upon contact with carbon dioxide. To achieve higher cooling efficiency, the size of internal compartments (8) should generally match those of respective sides and bottom of the cooler. In addition, the inner side (81) of the internal compartment (8) should be closely adjacent to the respective inner side of the cooler, means the inner side of the right side (21), the inner side of the left side (31) and the inner sides of the back and the frond sides, which are not shown in the figures, so as to enable efficient and rapid flow of cold from the internal compartment (8) to the interior of the picnic cooler (1), and the space between the outer side (82) of the internal compartment (8) and the respective outer side of the cooler, means the outer side of the right side (22), the outer side of the left side (32) and the outer sides of the back and the frond sides, which are not shown in the figures, should be filled with standard or other insulation material so as to prevent loss of cold to the exterior carbon dioxide should flow from the internal compartment (8) into the interior of the cooler (1). In addition, the internal compartment (8) may have metal protrusions, mesh partitions, and so on, to create a more efficient cooling effect, i.e. to increase contact surface between the metal and the carbon dioxide introduced into the internal compartment.

Shape of internal compartment (8): The internal compartment (8) may be shaped like a narrow rectangular box and should be designed to be integrated into one side of the picnic cooler. Several such internal compartments may be integrated into one or more sides of the cooler, and even into its bottom. The cooler (1) may alternatively be constructed so that the internal compartment (8) has the general shape of a box with four sides and a bottom, and is built into the picnic cooler, as depicted for instance in the drawings attached to the application.

Introduction of carbon dioxide into the internal compartment (8): The picnic cooler is equipped with an adapter (9) to which to a canister (99), containing carbon dioxide at a low temperature, may be attached. The adapter has a passage (91) designed to enable the introduction of carbon dioxide from the carbon dioxide canister (99) into the internal compartment (8). The passage (91) may be an opening, an aperture, or even a tubule, depending on the distance between the adapter (9) and the side of the internal compartment (8), according to the specific implementation of the invention. The user can connect a carbon dioxide canister (99) to the adapter (9) and execute a rotation or pushing motion, according to the specific implementation of the invention, thus introducing carbon dioxide from the canister (99), through the adapter (91), into the internal compartment (8). The internal compartment (8) also has a ventilation opening (92) between the inner compartment (8) and the interior of the picnic cooler (1), thus enabling air and carbon dioxide to flow out of the internal compartment. The internal compartment may, of course, have several ventilation openings (92), which may be located in the sides and/or bottom of the cooler. When the cooler (1) is no longer sufficiently cold, the user may attach another canister of carbon dioxide (99) to the adapter (9), and introduce carbon dioxide into the internal compartment (8), and so on and so forth.

FIG. 1 presents a cross-section of the picnic cooler (1) with an internal compartment (8), an adaptor (9), a passage (91) and ventilation openings (92).

Figure 2:
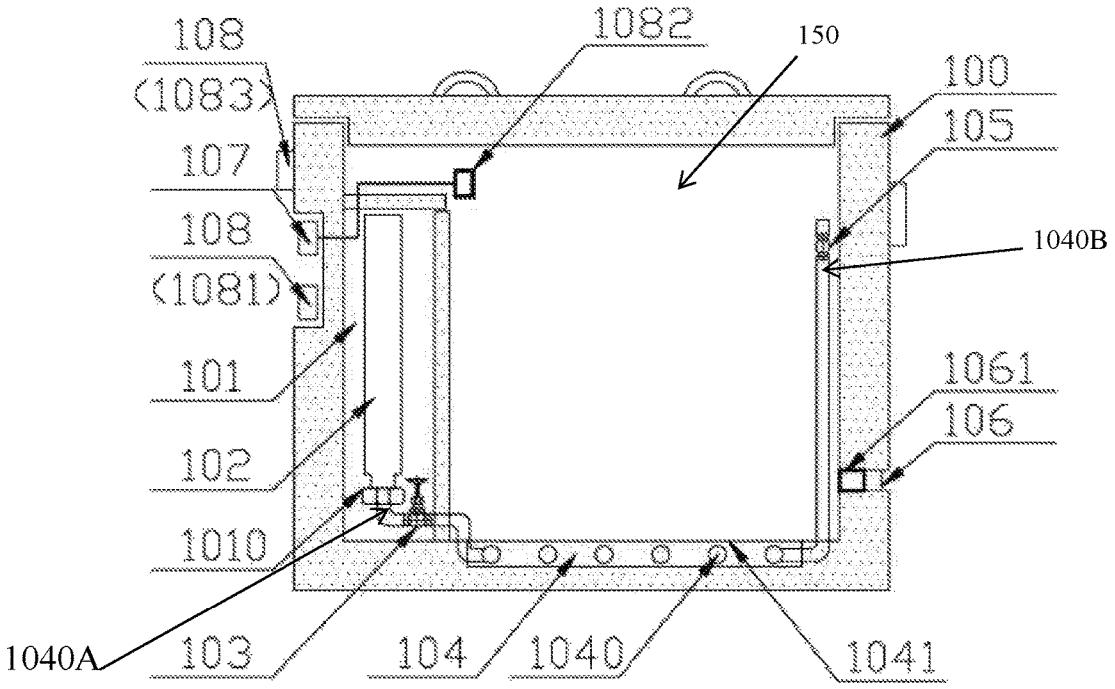
FIG. 2 presents a schematic cross-section of a picnic cooler (100) with a compartment designed to contain a gas canister (101), a gas canister (102), an electric spigot (103), a cooling apparatus (104) that includes piping (1040) and an upper plate (1041), an aperture through which gas is introduced into the cooler (105), an aperture (106) with a unidirectional valve (1061) through which gas is released from the cooler, an electric power source (107), and a command and control system (108) that includes a controller (1081), a temperature sensor (1082), and a display and operation panel (1083).
Figure 3:
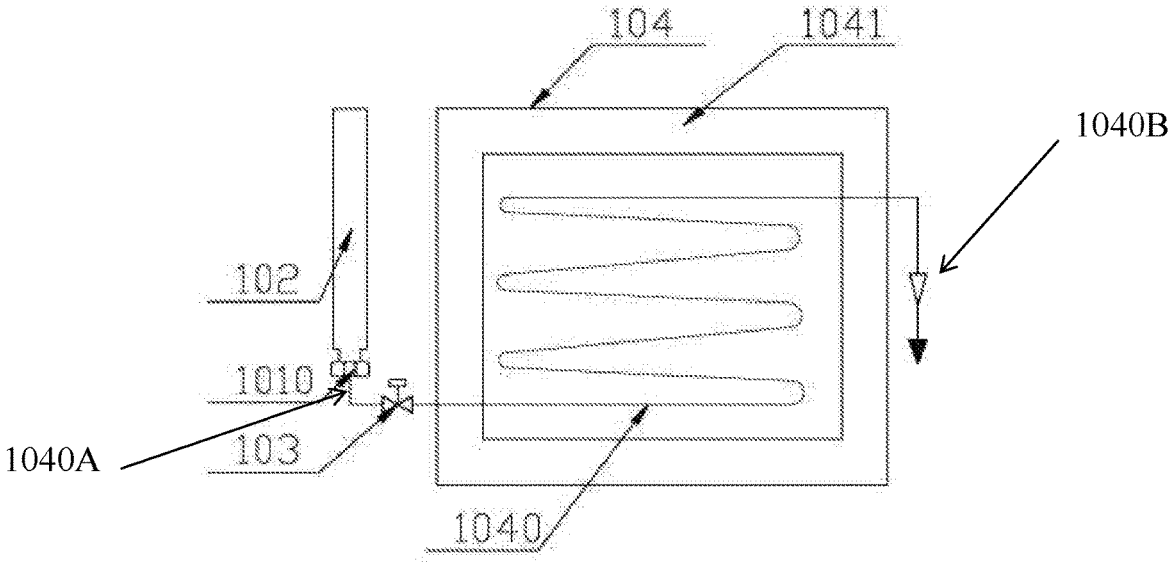
FIG. 3 presents a schematic description of the cooling apparatus (104), which includes piping (1040) and an upper plate (1041).

The second version of the invention, subject of the present patent application, refers to a picnic cooler (100), which is depicted schematically in FIGS. 2 and 3. The picnic cooler (100) is based on an independent and active cooling system. The cooler (100) is equipped with a designated gas tank compartment (101) in which a gas tank (102) may be installed, an off/on electric spigot (103), a first cooling apparatus (104), an aperture for introducing carbon dioxide into the cooler (105), an aperture for releasing carbon dioxide from the cooler (106), an electric power source (107), and a command and control system (108).

The designated carbon dioxide canister compartment (101) can be located within the cooler, as depicted for instance in the drawings attached to the application; alternatively, it may be located or in an external compartment. The compartment (101) is equipped with an adapter (1010) to which the opening of the carbon dioxide canister (102) is connected, enabling the user to exchange the empty, spent carbon dioxide canister with a new, full carbon dioxide canister according to need. A tubule, extending from the adapter (1010), introduces carbon dioxide from the canister (102) into the cooling apparatus (104). The electric spigot (103) is positioned on said tubule or on the adapter itself (1010) and is controlled by the command and control system (108).

The cooling apparatus (104) is made of a metallic material or any other suitable material and can have a variety of shapes. In addition, it can be located anywhere within the picnic cooler. The cooling apparatus (104) can, for instance, consist of a system of very thin piping (1040) and an upper metallic plate (1041) that serves also as the inner bottom of the cooler (100), as depicted for instance in the drawings attached to the application. When carbon dioxide flows from the canister (102) into the cooling apparatus (104) and the piping system (1040), the cooling apparatus (104) becomes cold, due, among other things, to the pressure drops of the carbon dioxide, which in turn causes the interior of the picnic cooler (100) to become colder. It means that the gas flows inside the piping system (1040) when it is in a gaseous state, carbon dioxide that is introduced into the cooling apparatus (104) and the piping system (1040) flows into the interior of the cooler through the aperture (105). The term "carbon dioxide" as used in the present patent application refers both to carbon dioxide gas as well as any other gas or substance that is used for cooling purposes by expansion; based on the principle that the droplets of pressure chill the surroundings, in our case is the piping twisted system (1040). Therefore the term "carbon dioxide" at the present invention and in the claims should be read as any kind of gas that its temperature drops down in a rapid expansion.

The aperture for releasing carbon dioxide from cooler (106) enables air and gas to flow out from the interior of the cooler. Said aperture is equipped with a unidirectional valve (1016) that is activated upon reaching a preset pressure, which may be slightly higher than one atmosphere (which is the pressure of the air outside the cooler).

The objective is to prevent buildup of internal pressure within the cooler, which may detrimentally affect the cooler, its cover or its contents.

The command and control system (108) includes a controller (1081) and a temperature sensor (1082) that measures the temperature within the picnic cooler. The command and control system (108) may also be equipped with a display panel (1083), which in turn may be equipped with a touch-screen or a series of buttons that are used to operate the system. The command and control system (108) controls the cooling of the cooler (100) by transmitting a command to open the electric spigot (103) for time periods that are determined according to the difference between the actual temperature within the cooler and the desired temperature. The desired temperature may be preset or it may be determined by the user using the command and control system. The controller (1081) activates the electric spigot when the desired temperature is higher than the actual temperature within the cooler. The command and control system (108) can display a variety of data, such as the temperature inside the cooler, the temperature outside the cooler, the desired temperature, the charging status of the batteries (107), the amount of carbon dioxide remaining in the canister (102), and so on. In addition, the cooler may be equipped with built-in speakers, which may be connected to a Bluetooth and/or USB socket and/or any socket in another structure, and enable the user to play music etc. by means of a smart phone device or any other device with similar abilities.

FIG. 2 presents a schematic cross-section of the picnic cooler (100) with a compartment that contains a gas canister (101), a gas canister (102), an electric spigot (103), a cooling device (104) that includes piping (1040) and an upper plate (1041), an aperture for introducing gas into the cooler (105), an aperture for releasing gas from the cooler (106) and a unidirectional valve (1061), an electric power source (107), and a command and control system (108) that includes a controller (1081), a temperature sensor (1082), and a display and activation panel (1083). FIG. 3 resents a schematic description of the cooling device (104) that includes piping (1040) and an upper plate (1041).

As it is understood from the above explanations and the figures, the picnic cooler (100), includes a food compartment (150), a carbon dioxide tank compartment (101), a carbon dioxide tank adapter (1010), an electric spigot (103), a cooling apparatus (104), an electric power source (107), and a command and control system (108).

The carbon dioxide tank compartment (101) is designed to receive a carbon dioxide tank (102). The food compartment (150) includes a release aperture (106) with unidirectional valve (1061) that is designed to release air and gas outside from the interior of the food compartment (150).

The cooling apparatus (104) includes a twisting piping system (1040) and an upper metallic plate (1041), wherein said upper metallic plate (1041) serves also as the inner bottom of the food compartment (150). The first end (1040A) of the twisting piping system (1040) is connected to the adapter (1010) and the second end (1040B) of the twisting piping system (1040) includes a secondary aperture (105) that is positioned inside the food compartment (150).

The carbon dioxide tank (102) is designed to be connected to the carbon dioxide tank adapter (1010), and the electric spigot (103) is designed to open and close the carbon dioxide tank (102) and to be controlled by the command and control system (108).

The command and control system (108) includes a controller (1081), a temperature sensor (1082) that measures the temperature inside the food compartment (150), and a display panel (1083). The command and control system (108) is designed to control the temperature of the food compartment (150) by transmitting a command to open and close the electric spigot (103) for certain periods of times.

When the carbon dioxide flows from the carbon dioxide tank (102) into the piping twisted system (1040) then the piping twisted system (1040) becomes cold due to a pressure drop and cooling the upper metallic plate (1041) that in turns cooling the food compartment (150). The flow of the gas from the piping twisted system (1040) into the interior of the food compartment (150) through the secondary aperture (105) causes additional pressure drop and the carbon dioxide become colder and assist to cool the interior of the food compartment (150).

Figure 4:
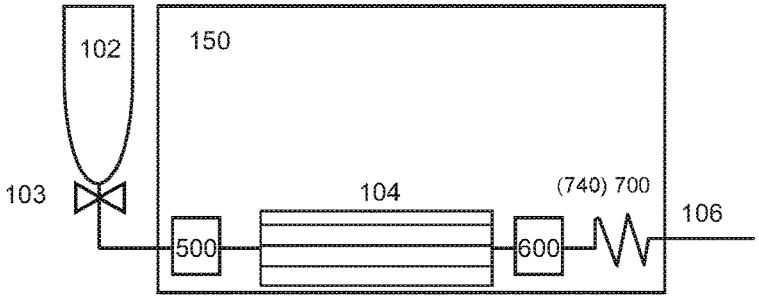
FIG. 4 presents a schematic description of the cooling apparatus (104) which includes two sealing ring (500) and (600) and two cooling apparatuses (104) and (700).

The abovementioned second version of the invention subject of the present patent application has another advantageous variation which is similar to the explanations above, but with the following changes, as understood from FIG. 4 and the followings: A picnic cooler (100), comprising: a food compartment (150), a gas tank compartment (101), an off/on electric spigot (103), a first sealing ring (500) with a first fixed-sized narrow aperture (501), a first cooling apparatus (104), a second sealing ring (600) with a second fixed-sized narrow aperture (601), a second cooling apparatus (700), an electric power source (107), and a command and control system (108);

wherein the gas tank compartment (101) is designed to receive a gas tank (102) so that the opening of said gas tank (102) is facing downward and connected to the off/on electric spigot (103);

wherein the first cooling apparatus (104) includes a first twisting piping system (1040) and wherein the second cooling apparatus (700) includes a second twisting piping system (740), wherein said first and second twisting piping systems are attached to an upper metallic plate (1041) that serves as a bottom of the food compartment (150).

wherein a first end (1040A) of the first twisting piping system (1040) is connected to the first sealing ring (500) that is connected to the off/on electric spigot (103) and a second end (1040B) of the first twisting piping system (1040) is connected to the second sealing ring (600) that is connected to the second cooling apparatus (700).

wherein a ratio between a diameter of the second aperture (601) and a diameter of the first aperture (500) is between 1.8 to 2.2; wherein a ratio between an inner surface area of the food compartment (150) and an outer surface area of the first and second twisting piping systems (1041) (740) is between 9 to 17.

wherein the command and control system (108) includes a controller (1081), and a temperature sensor (1082) that is designed to measures the temperature inside the food compartment (150); wherein the command and control system (108) is designed to control the temperature of the food compartment (150) by transmitting a command to open or close the off/on electric spigot (103);

whereby when gas flows from the gas tank through the first aperture of the first sealing ring into the first piping twisted system then the gas expands and cools the first cooling apparatus that cools the upper metallic plate, and whereby when the gas flows from the first cooling apparatus through the second aperture of the second sealing ring into the second piping twisted system then the gas further expands and cools the second cooling apparatus that cools the upper metallic plate that in turns cooling the food compartment.

In general, when gas flows from the gas tank (102) into the piping twisted system (1040) through the first sealing ring (500) the gas becomes colder due to rapid pressure drop of the gas whereby cooling the upper metallic plate (1041) that in turns cooling the food compartment (150); whereby the flow of the gas from the piping twisted system (1040) into the second cooling apparatus (700) through the second fixed-sized narrow aperture (601) of the second sealing ring (600) causes additional rapid pressure drop whereby said gas become colder and assist to cool the interior of the food compartment (150). The gas flows through narrow fixed-sized narrow aperture (501) and (601) of the sealing rings (500) and (600) and the pressure in the narrow apertures increases due to the narrowing of the cut-off area, and then after exit the gas is rapidly expands in the cooling apparatuses (104) and (700), its pressure is decreases due to that rapid expansion and it cools the environment. The role of the second sealing ring (600) is actually to produce a sort of rapid burst of additional gas expansion that causes further temperature drop. The presence of the sealing rings (500) and (600) with the fixed-sized narrow apertures (500) and (601) allows the cooling process.

FIG. 4 presents a schematic description of the cooling apparatus (104) which includes two sealing rings (500) and (600) and two cooling apparatuses (104) and (700).

The opening of the tank (102) is facing downward while connected to the off/on electric spigot (103) so the liquid part of the gas will stream outside of the tank and not the gasses that are located in its upper part.

The meaning of the term "off/on" in the component off/on electric spigot (103) is that the spigot can be in an open state or in a closed state, but cannot be controlled as to the extent of the opening. Electric spigots that can be controlled as to the extent of their opening are very expensive and therefore the invention employs an off/on electric spigot that together with two cooling apparatuses together with two sealing ring, one before the first cooling apparatus and the second sealing ring between the first and the second cooling apparatus creates a constant and efficient cooling.

The gas in the tank as usually may be purchased in the market when it is a type of CO2 for example is usually about 70 bars. The gasses pressure in the first cooling apparatuses (104) is determined by the apertures sizes of the first and the second sealing rings (500) and (600).

A desired pressure in case of CO2 may be from 25 to 40 bars, depend on the desired temperature. In experiments on a working prototype of the system, the following data became clear: when the pressure of the gas drops through the sealing ring from 70 bars at a 31 Celsius to 25 bars then the gas temperature become minus 10 Celsius; to pressure of 30 bars will lead to a temperature of minus 5 Celsius; pressure of 35 bars will lead to a temperature of 0 Celsius; and pressure of 40 bars will lead to a temperature of 5 Celsius.

The fixed-sized narrow aperture sizes of the sealing rings (500) and (600) are designed to maintain a gas pressure inside the first cooling apparatus (104) from 20 to 40 bars (in case of CO2) when the off/on electric spigot is active.

The dimensions of the sealing ring, the cooling apparatuses, the volume of the cooler and the other parameters should be suit and fit to the desired temperature. The gas flows constantly from the first cooling apparatus (104) through the second sealing ring (600) to the second cooling apparatus (700) and the invention employ this pressure drop to cool the cooler. The pressure in the second cooling apparatus (700) is 1 (one) bar and then the gas flows outside from it. Controlling the temperature of the cooler (100) is done solely by opening and closing the off/on electric spigot.

Figure 5:
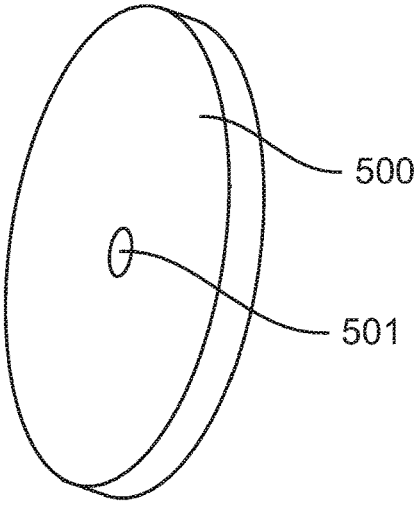
FIGS. 5 and 6 depict the sealing ring (500) and (600).
Figure 6:
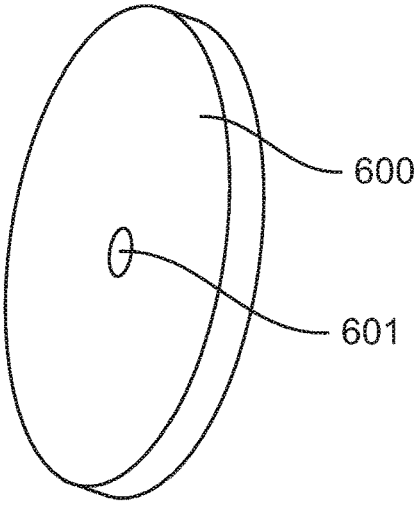
Figure 7:
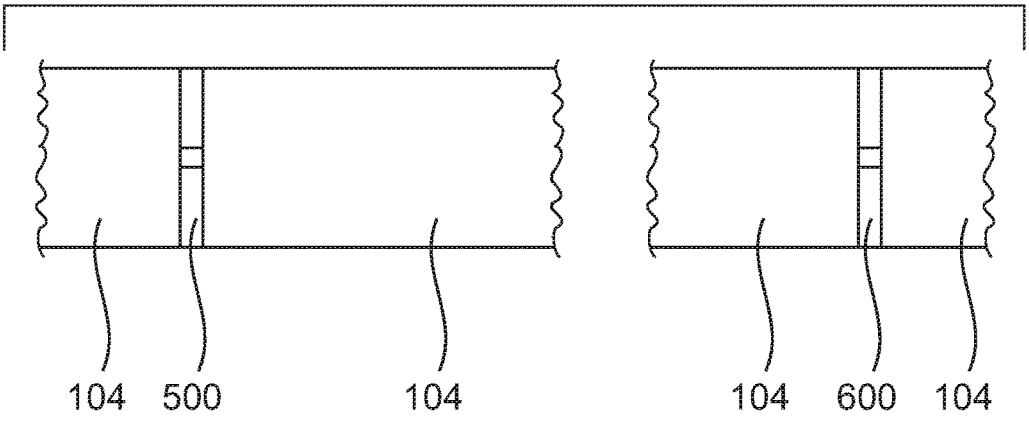
FIG. 7 depicts the first cooling apparatus (104) and the sealing rings (500) and (600).

Each one of the sealing rings (500) and (600) is in fact a small disc with narrow aperture (501) and (601) accordingly, as depicted for example in FIGS. 5 and 6. The first cooling apparatus (104) is in fact a narrow pipe in which the sealing rings (500) and (600) are positioned as depicted in the drawings. So, if the diameter of the pipe 104 is about 5 mm then the diameter of the narrow apertures (501) and (601) can be about 0.5 mm, as depicted for example in FIG. 7.

The cross section of the pipe 104 at the point where the sealing ring 500 is mounted is very narrow relative to the general cross section of the pipe 104, and so is the point at which the sealing ring 600 is positioned. The second cooling apparatus (700) is also a twisted pipe as the first cooling apparatus (104). The first cooling apparatus (104) has one entrance which is the narrow aperture 501 of the first sealing ring 500 and has one exit which is the narrow aperture 601 of the second sealing ring 600. The second cooling apparatus (700) also has one entrance which is the narrow aperture 601 of the second sealing ring 600 and one exit which is the aperture 106.

As stated above, the gas inside the gas tank (102) is about 70 bar. When a certain quantity of gas is splashed outside from the gas tank (102) into the cooling apparatuses (104), which in fact is a long twisted narrow pipe, this quantity of gas is expand in the volume of the cooling apparatus (104) and by that its pressure drops to about 25 to 40 bar. When the gas rapidly expands it becomes colder, similar to the principles of refrigerators and air conditioners. The part of the pipe 104 between the first sealing ring 500 and the second sealing ring 600 is in fact like a container that contains that gas. This gas flows constantly from this part of pipe 104 through the narrow aperture 601 of the second sealing ring 600 into the second cooling apparatus (700). In this point the gas rapidly expands too, gets colder and cools the environment, as explained above. The gas in the second cooling apparatus (700) is in a pressure of one bar.

What is claimed is:

1. A picnic cooler, comprising: a food compartment, a gas tank compartment, an off/on electric spigot, a first sealing ring with a first aperture, a first cooling apparatus, a second sealing ring with a second aperture, a second cooling apparatus, an electric power source, and a command and control system;

wherein the gas tank compartment is designed to receive a gas tank so that the opening of said gas tank is facing downward and connected to the off/on electric spigot;

wherein the first cooling apparatus includes a first twisting piping system and wherein the second cooling apparatus includes a second twisting piping system, wherein said first and second twisting piping systems are attached to an upper metallic plate that serves as a bottom of the food compartment;

wherein a first end of the first twisting piping system is connected to the first sealing ring that is connected to the off/on electric spigot, and wherein a second end of the first twisting piping system is connected to the second sealing ring that is connected to the second cooling apparatus;

wherein a ratio between a diameter of the second aperture and a diameter of the first aperture is between 1.8 to 2.2; wherein a ratio between an inner surface area of the food compartment and an outer surface area of the first and second twisting piping systems is between 9 to 17;

wherein the command and control system includes a controller, and a temperature sensor that is designed to measures the temperature inside the food compartment; wherein the command and control system is designed to control the temperature of the food compartment by transmitting a command to open or close the off/on electric spigot; and whereby when gas flows from the gas tank through the first aperture of the first sealing ring into the first piping twisted system then the gas expands and cools the first cooling apparatus that cools the upper metallic plate, and whereby when the gas flows from the first cooling apparatus through the second aperture of the second sealing ring into the second piping twisted system then the gas further expands and cools the second cooling apparatus that cools the upper metallic plate that in turns cooling the food compartment.

* * * * *